US005562064A

United States Patent [19]

Cunningham et al.

[11] Patent Number: 5,562,064

[45] Date of Patent: Oct. 8, 1996

[54] APPARATUS AND METHOD FOR ASSESSING DAMAGE AND PATCHING OPENINGS IN HULLS OF MARINE VESSELS

[75] Inventors: Christopher C. Cunningham, Boston; Marcel P. J. Gaudreau, Lexington, both of Mass.; Axel Sigmar, Sugar Land, Tex.; Edward M. Hogan, Landenberg, Pa.

[73] Assignee: Diversified Technologies, Inc., Bedford, Mass.

[21] Appl. No.: 399,061

[22] Filed: Mar. 8, 1995

[51] Int. Cl.[6] ..... B63B 43/16

[52] U.S. Cl. ..... 114/229; 29/402.14; 227/9

[58] Field of Search ..... 114/227–229, 259, 114/222; 29/402.09, 402.14, 402.15; 405/190, 191; 411/440, 441; 227/9–11

[56] References Cited

U.S. PATENT DOCUMENTS

| | | | |
|---|---|---|---|
| 373,133 | 11/1887 | Duncan . | |
| 770,078 | 9/1904 | Krüger . | |
| 932,720 | 8/1909 | Reinhardt . | |
| 1,070,260 | 8/1913 | Jameson . | |
| 1,573,909 | 2/1926 | Blumberg . | |
| 3,183,876 | 5/1965 | Kronhaus . | |
| 3,381,485 | 5/1968 | Crooks et al. | 405/191 |
| 3,400,684 | 9/1968 | Gerardi . | |
| 3,669,055 | 6/1972 | Buce . | |
| 3,756,294 | 9/1973 | Rainey . | |
| 4,010,619 | 3/1977 | Hightower et al. | 405/191 |
| 4,026,233 | 5/1977 | Cox . | |
| 4,821,665 | 4/1989 | Matthias et al. | 114/222 |
| 4,981,097 | 1/1991 | Beyrouty . | |
| 5,009,180 | 4/1991 | Holt . | |
| 5,025,972 | 6/1991 | Finlan | 114/227 |
| 5,195,446 | 3/1993 | Riddell . | |
| 5,203,273 | 4/1993 | Sandlofer . | |
| 5,216,973 | 6/1993 | Gwinn . | |
| 5,253,605 | 10/1993 | Collins | 114/259 |

OTHER PUBLICATIONS

Warren, Williams J., "New Device to Curb Oil Spills," *American Shipper* , p. 68, Nov. 1991.

Knee, Richard, "Shippers Will Pay the Freight for Keeping Fleets Ship–Shape," *American Shipper* , p. 70, Nov. 1991.

*Primary Examiner*—Sherman Basinger

*Attorney, Agent, or Firm*—Testa, Hurwitz & Thibeault, LLP

[57] ABSTRACT

A remotely-operated unmanned vehicle attached to the hull of a marine vessel by electromagnets surveys the hull for damage. The vehicle attached to the hull is electronically controlled from a remote location. An imaging system on the vehicle provides an operator with images of the vessel's hull and the surrounding environment. Once damage has been found and assessed, the vehicle applies a patch over the damaged opening in the hull to prevent cargo outflow and water inflow. The patch, which resists puncturing and tearing, is constructed from one or more sheets of flexible material having dimensions appropriate to cover most openings.

18 Claims, 6 Drawing Sheets

APPARATUS AND METHOD FOR ASSESSING DAMAGE AND PATCHING OPENINGS IN HULLS OF MARINE VESSELS

FIELD OF THE INVENTION

The invention relates in general to marine oil and hazardous chemical spill response and prevention, as well as marine vessel damage assessment and repair; more particularly, the present invention relates to a system and its associated operation which locates, assesses, and closes openings in the hull of a tanker, barge, or other similar structure which may contain potentially hazardous, polluting, or valuable cargo.

BACKGROUND OF THE INVENTION

Losses (including loss of cargo and pollution) resulting from accidents occurring in a body of water such as an ocean, sea, lake, or river have historically been a problem for marine vessels such as tankers, barges, and other ships. Accidents involving marine vessels historically include, but are not limited to, groundings, collisions, rammings, structural failures, and explosions. For vessels transporting cargo, if an opening or breach in a hull, tank, or other containment structure occurs as a result of an accident, the internal cargo is susceptible to accidental discharge from the vessel into the environment, especially if the cargo is a liquid such as oil. Discharge of a cargo such as oil into an environment such as an ocean or river often incurs costs such as from cleanup, fines, damage claims, cargo value losses, insurance rate increases, and public image losses. Preventing, reducing, or limiting the rate of the discharge of cargo into the environment averts or mitigates these costs.

In addition, damage sustained to vessels can have adverse effects on the stability of the vessel. Since the location and extent of the damage is often unknown at the time of an accident, the operator of the vessel cannot make well-informed decisions about the best strategy for removing his vessel from danger, or about the extent of the potential threat of accidental discharge of cargo. Often experienced divers must be transported to the site and enter the water to assess the damage, exposing themselves to a potentially dangerous situation.

Finally, holes in the hull of a vessel can result in an influx of water and may result in the sinking of the vessel. Various techniques have been used to keep a damaged vessel afloat, such as wrapping the sail of a ship around a breached hull to prevent water inflow.

Various devices are known for emergency repair of a ship to prevent it from sinking. U.S. Pat. No. 373,133 to Duncan, U.S. Pat. No. 1,070,260 to Jameson, U.S. Pat. No. 3,183,876 to Kronhaus, U.S. Pat. No. 3,400,684 to Gerardi, and U.S. Pat. No. 4,026,233 to Cox each disclose covers used to encase an opening in the hull of a marine vessel. These disclosed devices are designed to prevent water from entering the vessel.

A slightly different technique is disclosed in U.S. Pat. No. 1,573,909 to Blumberg which discloses the use of a mattress to cover a hole in the hull of a vessel. The mattress also includes a pipe or hose placed through the mattress for the purpose of pumping water out of the hole.

For vessels transporting cargo, numerous marine types of oil and hazardous chemical spill response equipment and techniques are presently in use to mitigate losses which occur as a result of accidental discharge of the cargo.

Presently, with a few exceptions, marine oil and hazardous chemical spill response equipment and techniques generally focus on containing, recovering, or cleaning up a cargo spill rather than preventing cargo discharge. For example, conventional mechanical containment, recovery, and cleanup equipment includes booms, skimmers, oil/water separators, beach cleaning equipment, pumps, storage tanks, and sorbents. Conventional chemical containment and cleanup includes dispersants, gelling agents, and various other chemical agents. Other techniques such as in situ burning and bioremediation are also presently used in spill response as well. Numerous products pertaining to all of the above types of equipment and techniques can be found in the *World Catalogue of Oil Spill Response Products* published by Port City Press of Baltimore, Md. or the *International Oil Spill Control Directory* published by Cutter Information Corporation of Arlington, Mass.

Some present technologies, equipment, and techniques seek to prevent the accidental discharge of cargo. Double hulls, double bottoms, and double sides are different types of naval architecture which prevent spillage in some cases by providing an additional hull layer, wherein an outer hull layer absorbs much of the impact during an accident so that an inner hull layer is not breached and can contain the cargo. Internal pumping and cargo transfer mechanisms such as the SCOL by Energy Transportation Group, Inc. of New York, N.Y. have also been used to transfer the cargo in a damaged tank to an undamaged tank before all cargo is discharged.

Another technique involves the use of liners. Liners, a high-strength flexible membrane covering the inner wall of a tank, are intended to contain cargo when the hull is breached. Several practical obstacles exist with the use of liners, including their inability to conform to the intricate inner structure of most tank vessels and their hindrance of normal hull inspections. The National Research Council assessed the practical obstacles associated with liners and found the obstacles to be insurmountable.

Many patents have disclosed several inventions which seek to cover or close openings in the hull of a vessel, either to prevent the influx of water which may sink the vessel or to prevent the outflow of cargo.

U.S. Pat. No. 770,078 discloses a flexible curtain for covering openings in vessels with the curtain being unrolled along side the ship to cover a hole in the hull. Magnets on the curtain assist in securing it against the hull over the opening.

U.S. Pat. No. 932,720 discloses a means for closing holes in a steel hull in which a series of magnets may be activated for securing an inflatable bag or blanket to the hull. The blanket is made of a strong material, such as canvas and rubber combined, which is impervious to water or air.

U.S. Pat. No. 3,669,055 discloses an apparatus and method for sealing an opening in the hull of a vessel. The apparatus used to seal the opening is a cover which is secured to the hull. The cover is formed of an elastomeric material such as rubber and the outer layer has an armored surface to protect it from sharp, jagged edges which may form around the opening.

U.S. Pat. No. 3,756,294 to Rainey discloses an apparatus whereby an elongated conduit with an enlarged end is attached to the hull magnetically over an opening in the hull to guide the oil from its source of leakage to a large sack-like underwater container which contains the spilled oil.

U.S. Pat. No. 5,216,973 to Gwinn uses a large sheet of flexible, durable, waterproof material which is deployed around the vessel to form a double hull type apparatus. The material is deployed from port to starboard (or vice versa) from a roll in a protective housing on deck. The material is pulled around the hull mechanically. Although the cargo is contained within the material, it still exits the hull which can be seen as a disadvantage. Also, it requires a large amount of material to implement this technique. The operator is not informed as to the extent of the damage from the accident.

U.S. Pat. No. 5,203,273 to Sandlofer uses a large skin, preferably with a dehydrated material, which is rapidly deployed around an oil transportation ship to absorb any spilling oil and to plug the hole.

U.S. Pat. No. 5,009,180 to Holt uses a flexible waterproof sheet to encase a portion of the hull to prevent the outflow of oil from a tanker. The sheet is deployed from the deck and it wraps around the hull from one side to the other covering the opening.

U.S. Pat. No. 5,195,446 to Riddell uses a sheet of flexible, liquid impermeable material having numerous electromagnets embedded within the sheet. By controlling the sequence in which the electromagnets are energized, the sheet may be incrementally attached to the hull of a vessel to cover an opening. Fluid assist members adjacent to the electromagnets are used to force the sheet towards the hull, and a separate flotation device is described which can transport the sheet towards the hull of the vessel and unroll it in the water prior to application to the hull.

Magna-Patch of Houston, Tex. utilizes a concept similar to that described in the Riddell patent. Magna-Patch cannot locate and assess damage to the extent capable of with the present invention. Unlike the present invention, the Magna-Patch device cannot be used effectively with moving vessels. The Magna-Patch device is not as effective as the present invention in covering long openings in a hull which are oriented along the length of the vessel. The Magna-Patch method requires continuous power to keep the patch in position on the hull.

Very few commercial products currently on the market perform external hull patching, and none known to applicants locate and allow for hull damage assessment and repair as does the present invention.

SUMMARY OF THE INVENTION

In general, the invention relates to a vehicle and method of locating and assessing damage to a marine vessel. The vehicle is a remotely operated, unmanned unit which is placed in the water external to the hull. The vehicle may be attached to the hull of the vessel by electromagnets or other suitable attachment means such as permanent magnets or pressure differentials located on the vehicle or vessel.

If electromagnets are used to attach the vehicle to the vessel, multiple electromagnets may be used to obtain the necessary holding force and to allow temporary de-energizing of the electromagnets to release debris accumulated on the magnet. The vehicle may be stored aboard the vessel and deployed if damage is suspected. The vehicle may be deployed along the surface of the vessel or in the water along side the vessel.

The vehicle traverse the vessel, surveying the hull for damage. The vehicle is equipped with video and imaging capabilities and other sensing elements for detecting a damaged section of the vessel hull. The vehicle transports a specially constructed patch to the damaged area and positions the patch over the opening (damaged area). Specially constructed fasteners having tips which are ballistically fired through the patch and into the hull secure the patch over the opening. A movable fastener-firing mechanism propels the fasteners into the patch securely imbedding them in the hull. Other means such as a water-proof adhesive may be used to secure the patch to the hull.

A cutting mechanism located on the vehicle severs any unused patch material from the applied patch material. The cutting mechanism may assume a variety of configurations such as a circular saw, a knife, scissors, or a hot cutting instrument.

The vehicle is propelled over the surface of the hull by motor driven wheels, where the motor being used can be a standard commercially available motor. Other methods of propelling the vehicle may be used such as jet propulsion, so that the vehicle in effect swims along side the vessel.

The vehicle begins its search for hull damage at or near the bow of the vessel. This starting point minimizes the forces acting against the vehicle by fluid currents running along the hull of a moving vessel.

An imaging system is provided on the vehicle to provide the operator with images of the hull and surrounding environment. The imaging system may include an ultrasonic or sonar imaging system which provides extended range and visibility through dark and opaque environments. The imaging system may also include a video imaging system which provides high-resolution video images. Using the described imaging features, the vehicle surveys the vessel for damage at a sufficient rate to quickly locate, inspect, and repair the damaged area before a significant percentage of the cargo escapes the containment tanks.

Once the vehicle locates the damaged area, the vehicle applies a patch over the opening. The patch is transported, positioned, and applied by the vehicle. The patch resists puncturing and tearing, and it is specially constructed from one or more sheets of flexible materials. It is configured with dimensions appropriate to cover an adequate percentage of openings which are likely to occur in the hull of the vessel.

The vehicle unrolls the patch from its stored position and places it over the damaged area. The vehicle secures the patch to the hull by ballistically firing fasteners into the patch as it is unrolled from the vehicle. The fastener includes a head, an elongated shaft, and a tip. The fastener tip and shaft completely penetrate the entire thickness of the patch and become embedded in the hull. The fastener tip does not, however, completely penetrate the entire thickness of the hull so as to create a through opening in the hull surface. The head of each fastener catches the patch and affixes it to the hull. As the patch is incrementally unrolled and firmly affixed to the hull, the damaged area is incrementally blocked.

A layer of self-expanding material forms part of the patch for sealing small openings between the fasteners and the edges of the patch. The self-expanding material may be a polymer. This polymer can also function to repair automatically punctures in the patch material.

The position along the width of the patch where each fastener is applied is controlled by mechanically moving a fastener-firing mechanism across the width of the patch. The fastener-firing mechanism attaches to and moves along a beam structure located on the vehicle, and the position along the length of the patch is controlled by incrementally unrolling the patch to increase its length. The firing mechanism can be adapted to vary the position of the fasteners along the width of the patch.

Once a section of the patch has been applied and securely attached to the damaged area, it may be severed from the remaining unrolled patch. The unrolled patch material is severed by cutting the patch along its entire length using a cutting mechanism mounted to the moveable fastener-firing mechanism. Severing the unused patch material from the applied patch enables the vehicle to retain the remaining patch material for later use if needed.

The unmanned remotely-operated vehicle attached to the hull may be controlled by a single operator from virtually any location, preferably from a safe control panel located onboard the vessel in the bridge or engine room. No manual labor or presence on deck is required by the operator. Operation of the vehicle is extremely simple and minimal training is required.

The vehicle may be securely and compactly stored in one of many available locations on deck where it can respond immediately to an accident, or it can be transported to an accident site for use.

It is an object of the present invention to provide the capability to locate and assess damage sustained to the hull of a marine vessel in the event of an accident by utilizing a mobile unmanned vehicle attached to the hull with propulsion, video, imaging, and sensing capability included.

It is also an object of the present invention to prevent the accidental outflow of cargo from a marine vessel which has sustained damage to its hull by affixing a specially-constructed patch over openings by ballistically-firing special projectiles through the patch into the hull around damage openings.

It is also an object of the present invention to be capable of patching multiple openings, each having an arbitrary dimension, orientation, and location in the hull of a marine vessel.

It is also an object of the present invention to patch openings in the hull of a marine vessel in a manner which is safe for both the operator and any personnel in the vicinity by utilizing only a single operator without the requirement for manual labor who, from a safe remote location, controls a vehicle to survey and patch openings in the hull.

It is also an object of the present invention to patch openings in the hull of a marine vessel in the vast majority of weather and sea state conditions when the vessel is either stopped or moving.

The foregoing and other objectives, aspects, features, and advantages of the invention will become more apparent from the following description of the drawings, the detailed description, and the claims.

DESCRIPTION OF THE INVENTION

Figure 1:
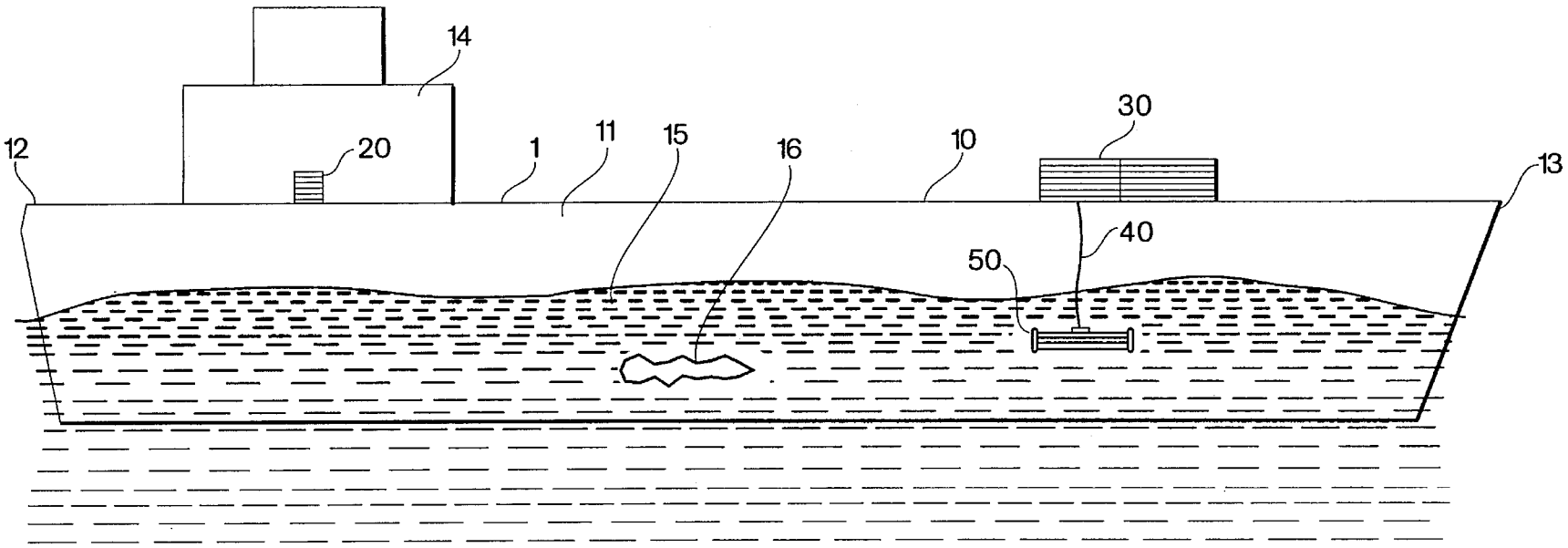
FIG. 1 is the side view of a damaged marine vessel and an apparatus showing the components which may comprise a damage locating vehicle formed in accordance with the teachings of this invention

In FIG. 1, there is shown a marine vessel 1 that is either stopped or moving in the water 15. In one embodiment, a remotely operated damage assessing vehicle 50 is stored aboard the vessel 1 at all times for immediate response to an accident. A control center 20 of the vehicle 50 is preferably located in the bridge 14 of the vessel 1, but can be located virtually anywhere, including off the vessel 1. The vehicle storage center 30 is preferably located on the outer edge of the deck 10 of the vessel 1 near the bow 13. The vehicle 50 can be stored in the vehicle storage center 30 until it is needed to respond to an accident. Of course, the vehicle may be stored in a location other than in the vehicle storage center 30.

Data is transmitted between the vehicle control center 20 and the vehicle storage center 30 by either a hard-wired link such as a fiber optic or electrical conductor, or by radio or other transmission. Data transmitted between the vehicle control center 20 and the vehicle 50 is routed through the vehicle storage center 30. It is possible, however, to transmit data directly from the vehicle control center 20 to the vehicle 50.

The control center 20 should be as simple as possible to minimize training requirements. Control functions are handled by a computer located at the vehicle control center 20. The control computer monitor displays any relevant messages and data such as vehicle position, orientation, and speed. All necessary video imaging such as from video cameras or sonar imaging devices located on the vehicle can be displayed at the vehicle control center 20. Operator controls such as vehicle steering can also be located at the vehicle control center 20.

The vehicle storage center 30 is located in one of the available positions on deck 10 near its edge. The vehicle storage center 30 may be mobile, such as with wheels, or permanently positioned on deck 10. To keep equipment storage requirements small, the vehicle storage center 30 preferably consists of a simple structure housing a power generator, tether winches, and other equipment necessary for operating the vehicle 50, excluding the vehicle control center 20 interface and the vehicle 50 itself. When the vehicle 50 is not in use, the vehicle storage center 30 can be sealed-off from the environment with the vehicle 50 inside to prevent corrosion and weathering. The vehicle storage center 30 may be manually or electromechanically opened or forced open by the vehicle 50. Starting the generator, opening the housing, and other functions occurring at the vehicle storage center 30 may be controlled at the control center 20 through a hard-wired or radio transmitted communications channel.

In one embodiment, power from the generator and data communications are transmitted to the vehicle 50 from the vehicle storage center 30 through a single tether 40 containing both an electrical conductor for power and a fiber-optic link for control, images, data, and other communications. Commands from the vehicle control center 20 to the vehicle 50 are sent through the vehicle storage center 30 where they are routed through the fiber-optic link within the tether 40. The tether 40 is stored on a winch located in the vehicle storage center 30 and released as needed by the vehicle 50. It is possible to also construct the vehicle such that the generator and other communication devices are located outside the storage control center, and the transmission of generator power and other communications may be sent to the vehicle by a means other than a tether link.

In one embodiment, the vehicle 50 begins its search for damage 16 to the hull 11 from an area near the bow 13 of the vessel 1 and travels towards the stern 12 of the vessel 1. This manner of searching minimizes forces acting on the vehicle as it moves forward against water currents acting on the hull 11 of a moving vessel. A free-swimming vehicle 50 might be adequate for use with a vessel 1 which is dead stopped in calm water 15.

Figure 3:
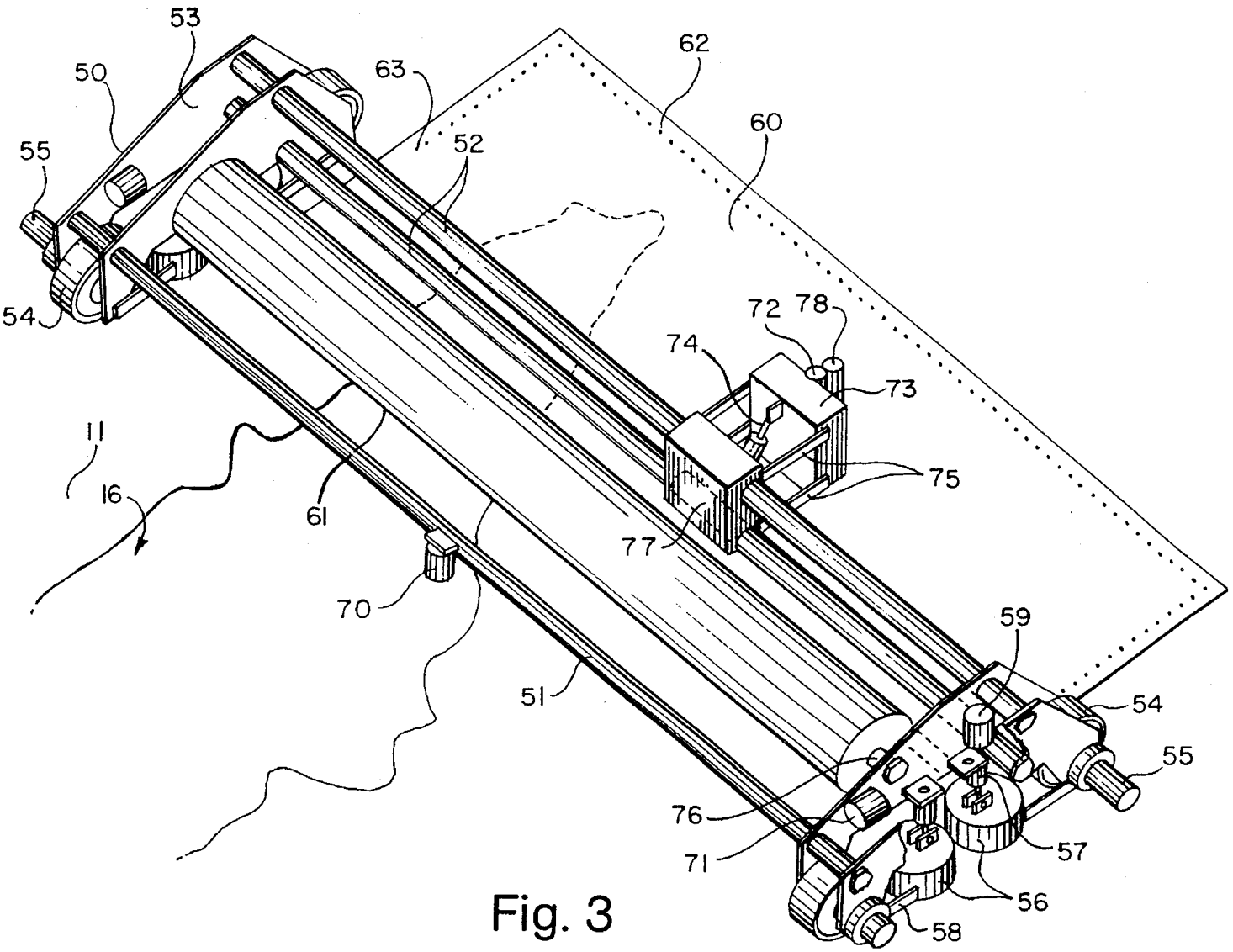
FIG. 3 is a plan view of the vehicle shown in FIG. 1.
Figure 4:
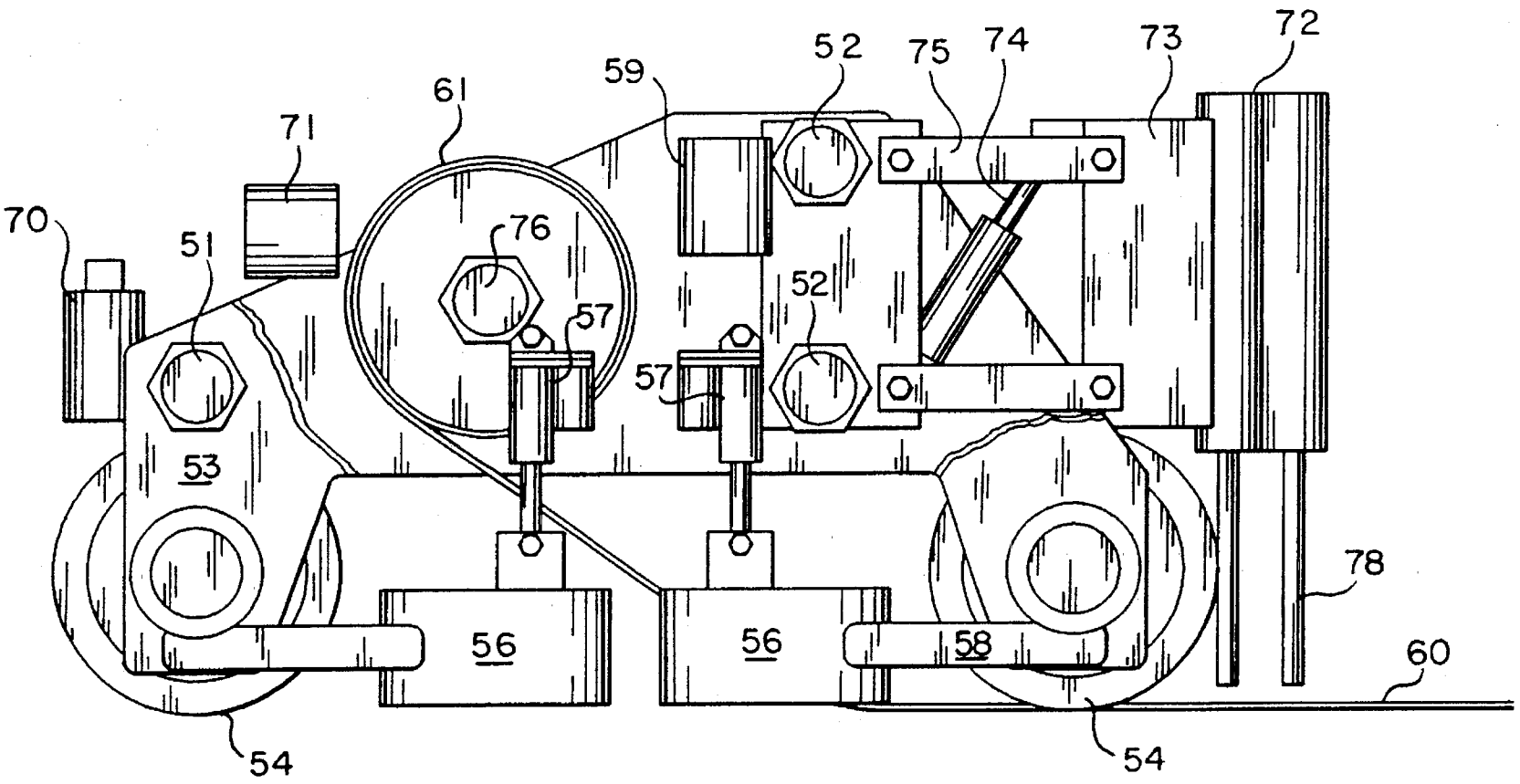
FIG. 4 is a side view of the vehicle shown in FIG. 3.

Referring to FIGS. 3 and 4, the side panels 53 of the vehicle 50 are shown as being transparent so that the internal components can be viewed. In this embodiment, the vehicle 50 is attached to the hull 11 by electromagnets 56 located on the vehicle 50.

The electromagnets 56 can generate a variable force which acts on the vehicle 50. The force is dependent upon the current applied to the coils of the electromagnet. The current through the electromagnet 56, and thus the force generated, can be precisely controlled by an electronic feedback control circuit using information about the current and flux through the gap. As shown, multiple electromagnets 56 on each side of the vehicle 50 are preferable to obtain the necessary vehicle holding force. Additionally, the current through the electromagnet may be varied to allow the vehicle to crawl along the vessel when searching for damaged areas of the hull. If multiple electromagnets 56 are used, each electromagnet 56 may be temporarily de-energized in order to release debris which may have accumulated on the magnet. The exact geometry and configuration of each electromagnet 56 can be optimized, but a standard annular geometry is acceptable.

The gap between the electromagnets 56 and the hull 11 is controlled by motorized lifting devices 57 and swing arms 58. The gap width can be approximated using knowledge of the current and the flux through the gap. These quantities can be measured with sensors located on the vehicle 50 or the vessel 1. Adequate current and flux sensors and lifting devices are available as standard commercial products. By maintaining an optimal gap and current, the electromagnets 56 apply a force appropriate to hold the vehicle 50 on the hull 11.

The vehicle 50 moves along the surface of the hull 11 by motor powered wheels 54. The wheels 54 have a rough, sharply spiked, outer surface to maximize the friction between the vehicle 50 and the hull 11. The motors 55 used to drive the wheels 54 should have sufficient horsepower to propel the vehicle 50, and should be waterproof. The motors 55, however, are not required to be variable speed motors. Many commercially available motors are suitable for propelling the vehicle 50.

An imaging system is provided on the vehicle 50 to provide the operator with images of the hull 11 and the surrounding environment. An ultrasonic or sonar imaging system 70 is included to provide extended range and visibility through dark and opaque environments. Adequate ultrasonic imaging systems are available as standard commercial products. Video equipment 71 and lighting are included on the vehicle 50 to provide high-resolution images. Adequate video and lighting systems are available as standard commercial products. The imaging systems 70 and 71 are mounted on a cross beam 51 located on the vehicle. Other mounting structures may be used to secure the imaging systems to the vehicle 50.

Figure 2:
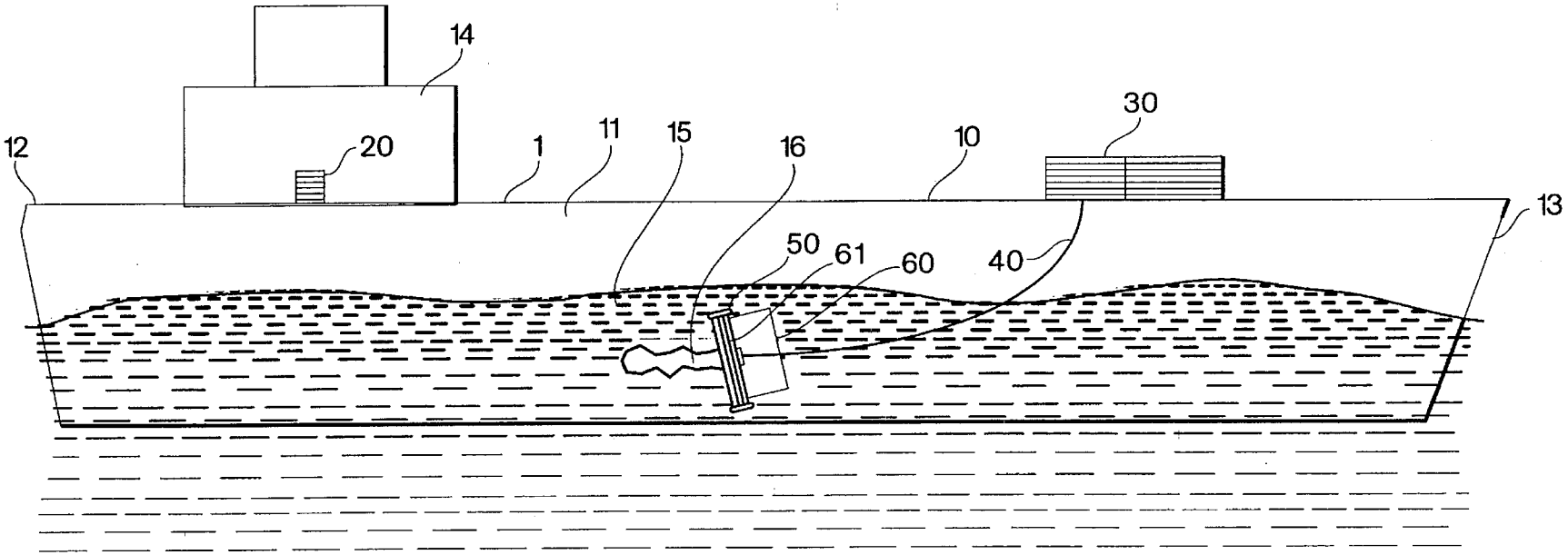
FIG. 2 is the side view of a marine vessel and the vehicle shown in FIG. 1.

Once the vehicle 50 locates and inspects an opening 16 (damage opening) in the hull 11, it applies a patch 60 over the opening 16 to prevent cargo 18 outflow and water 15 inflow. Referring to FIG. 2, the vehicle 50 is shown attached to the hull 11 of the vessel 1 under the water 15 line, patching an opening 16.

Figure 5:
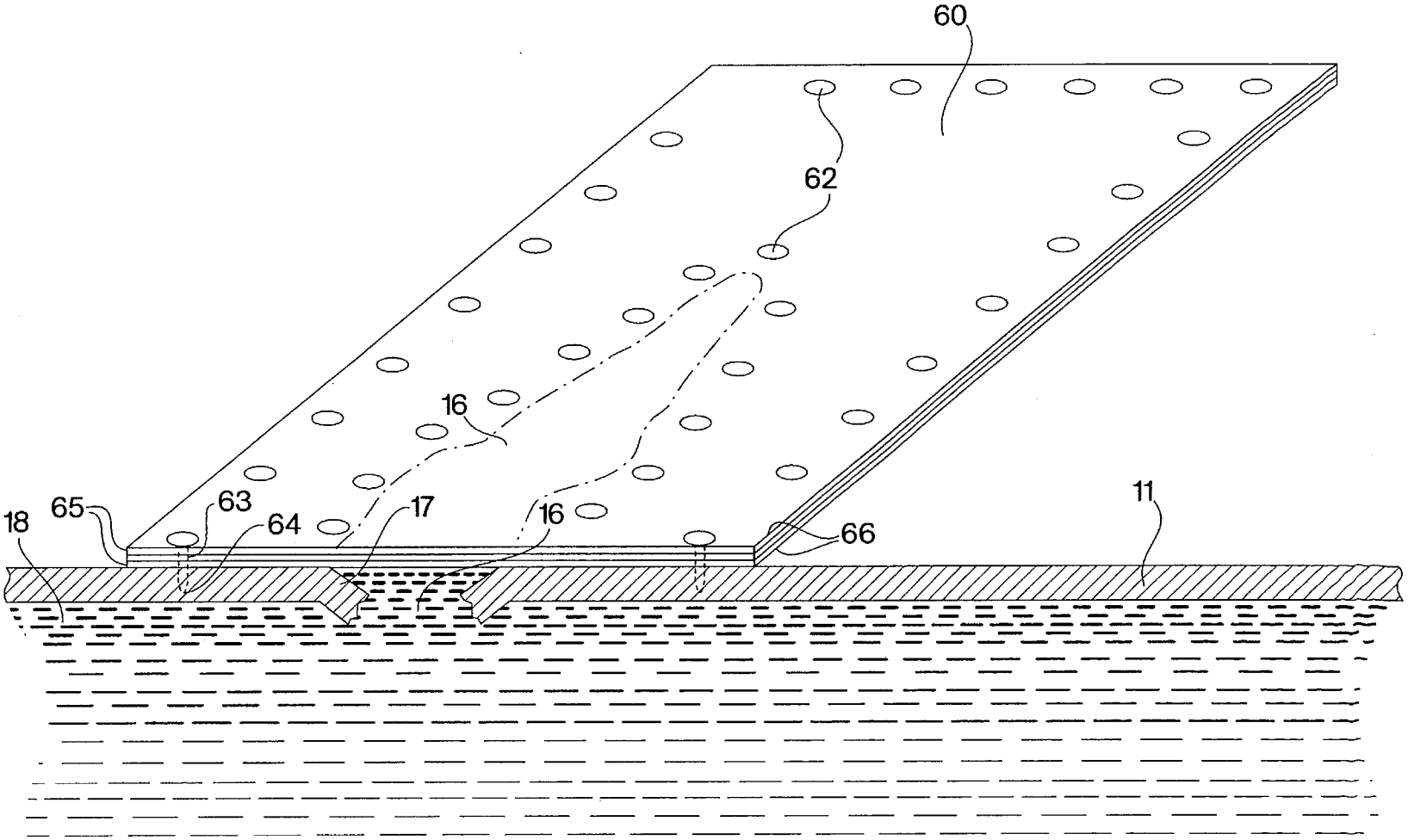
FIG. 5 is a plan view showing a multi-layer patch covering an opening in the hull, with fasteners penetrating the patch and embedded in the hull to secure the patch over the opening.

As shown in FIG. 5, the patch 60 can have one or more layers 65 and 66 of flexible materials used to cover openings 16. The total thickness of the patch 60 should be small relative to its length and width; a thickness of less than one inch is preferable so that the patch 60 can be rolled up around a core 76 and stored aboard the vehicle 50. The other dimensions of the patch 60 can vary depending on the application. The length and width of the patch 60 should be chosen to cover a variety of opening 16 sizes which are likely to occur in the hull 11. Based on statistical information known about the sizes and locations of actual damage openings 16 to vessels 1 which occurred in past accidents, a width of five to ten feet and a length of ten to one-hundred feet may be suitable. The length of the patch 60 can be much longer than the width because the patch 60 is rolled up and stored on the vehicle 50.

At least one layer 66 of the patch 60, the primary layer, is capable of withstanding normal pressure imposed on it by cargo 18 and pressure imposed on it by water 15. The primary layer 66 is formed from a tear resistant material. Sharp shards of metal 17 may be exposed to the patch 60, and, thus, the patch 60 must resist puncturing and tearing. The patch 60 also resists deterioration due to environmental elements such as ultraviolet radiation, cargo 18, and sea water 15. Dupont's Kevlar, Allied's Spectra, ballistic nylon, or combinations of the same are suitable for use as primary layer 66. Of course, other materials such as a layer of a polymer may be adequate for use as the primary layer 66 material.

In addition, the patch 60 includes a sealing layer 65 which seals gaps between the patch 60 and the hull 11. The sealing layer 65 may be a polymer which swells when it comes into contact with certain cargo 18. The sealing layer 65 may also function to self-seal punctures in the patch. Self-sealing materials are commonly known in the art. It is also possible to construct the patch without including a sealing layer.

Referring now to FIG. 2, application of patch 60 is performed by unrolling the rolled patch 61 from the vehicle 50 such that it covers the opening 16. Unrolling the patch material is performed by a standard motor 59. Many commercially available motors having the requisite power and safety constraints are sufficient for this purpose. As the length of rolled patch 61 is incrementally unrolled from the vehicle 50, it is immediately attached to the hull 11. The patch 60 is secured to the hull 11 by ballistically firing special fasteners 63 from the vehicle 50 through the patch 60, causing the fasteners 63 to become imbedded in the hull 11 as the rolled patch 61 is unrolled.

As the rolled patch 61 is incrementally unrolled and firmly affixed to the hull 11, the opening 16 is incrementally blocked. Small openings between the fasteners 63 and an edge of the applied patch 60 are sealed by the expanding layer 65. Layer 65 may be a material which expands on contact with the cargo 18. The expanding layer 65 may be formed from a polymer material.

Figure 6:
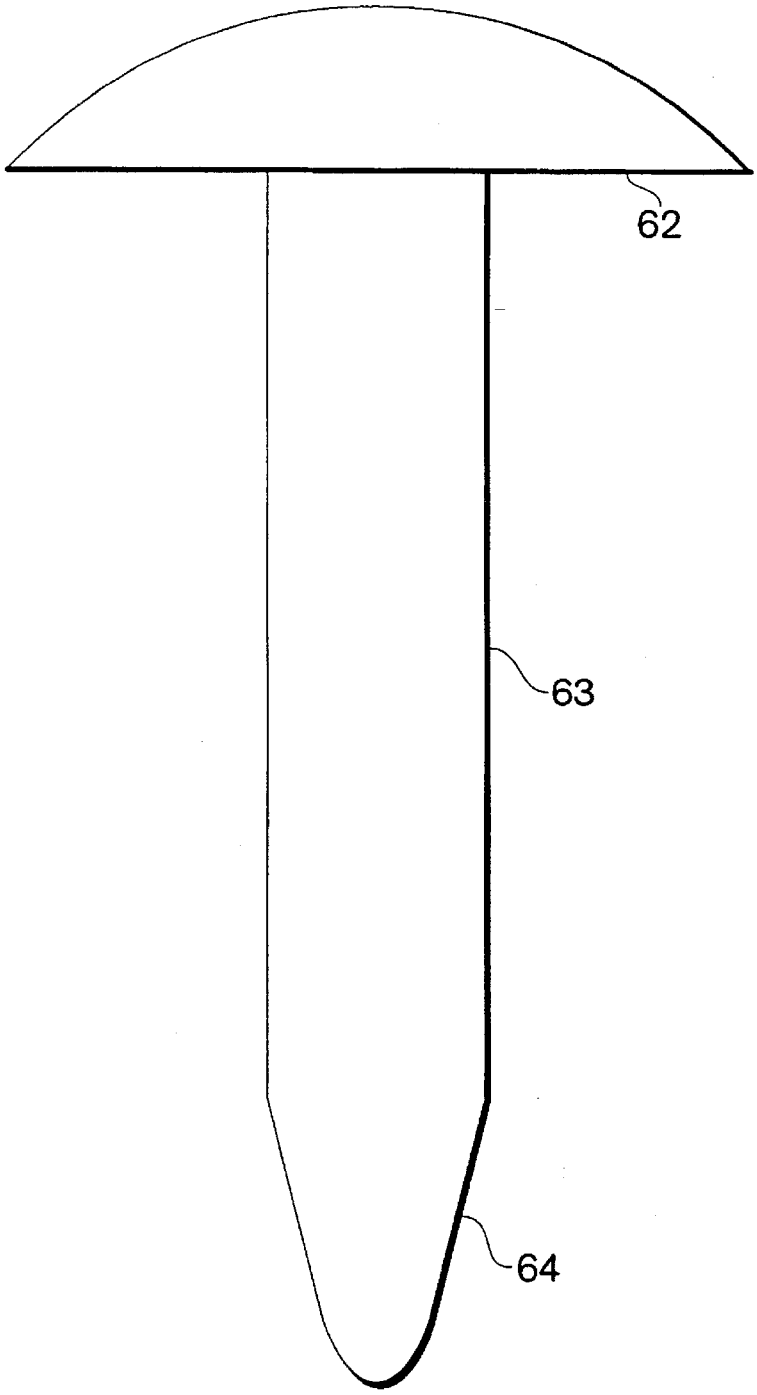
FIG. 6 shows one possible configuration of a fastener.

Referring to FIG. 6, in one embodiment, the fasteners 63 are cylindrically shaped. They have a front end which tapers to a tip 64, and a flanged distal end forming a head 62. Each fastener 63 is ballistically fired from a fastener-firing mechanism such that the tip 64 penetrates the thickness of the patch 60 and is imbedded in the hull 11 without completely penetrating the thickness of the hull 11. Upon imbedding in the hull 11, the fasteners 63 and hull 11 interact to create a friction lock, wedging the fastener 63 in the hull 11. The head 62 of each fastener 63 catches the patch 60, thereby, pinning it to the hull 11.

The friction lock between the fasteners 63 and the hull 11 is enhanced by inter-metallic bonding of the tip 64 to the hull 11 by an exothermic chemical reaction initiated upon contact of a fastener 63 with the hull 11. Many elements may be used to initiate the exothermic reaction, such as palladium (Pd) or transition metals (Co, Fe, Ni, Cu) with Al or Mg. Exothermic reactions of the type described are well known and used commercially in detonators for mining explosives and as one-shot destructible structures in the aerospace industry.

Each fastener 63 is fired from a mechanism 72 located on the vehicle 50. A storage chamber 73 stores the fasteners 63 until ready for use. The storage chamber 73 may store approximately 1000 fasteners. The storage chamber 73 is located adjacent the firing mechanism 72 and firing chamber.

The fasteners 63 are fed from the firing chamber and into the firing mechanism 72 where the fasteners 63 are fired into the patch 60 securing it to the hull 11. The firing mechanism 72 may be a fastener gun, and the firing mechanism 72 and the firing chamber may be formed as a single unit.

The use of a firing mechanism or fastener gun is well known. Such technology is widely used in the firearms and mining industries. Using the known technology, one of skill in the art can construct a firing mechanism 72 for loading and firing thousands of fasteners 63 under water 15 or above water 15 without igniting flammable vapors. Commercially-available, powder-actuated, multi-round fastener guns are presently used for hull repair, such as the UW10 manufactured by the Hilti Corporation in the Principality of Liechtenstein.

Ballistically firing the fasteners 63 into the hull 11 may create the possibility of generating pyrotechnic ignition due to sparking or temperature rise above the flash point of ambient vapors. The possibility of a pyrotechnic ignition may be eliminated by limiting the maximum temperature rise from the exothermic reaction to a temperature below any practical flash point which may be encountered.

The temperature rise caused by ballistically firing the fasteners 63 into the hull 11 can be calculated for a given fastener construction and velocity. Because the fastener 63 does not completely penetrate through the inner surface of the hull 11, the temperature rise generated from the frictional engagement of the fasteners 63 and the hull 11 is dissipated by conduction from the point of contact on the outer surface of the hull 11. This heat is dispersed quickly through the steel in the hull 11. Above the water line, it is possible to flood the vicinity of the fastener 63 impact on the outer surface of the hull 11 with a substance to prevent ignition.

The position where each fastener 63 is applied in the hull 11 is controlled by configuring the fastener gun 72 to move at preselected increments across the width of the patch 60 along one or more guideway rails 52. This linear motion is performed using a motor 77. Numerous commercially-available motors are adequate for this purpose. Control of the motor 77 is performed electronically by the operator remotely at the vehicle control center 20. The position along the length of the patch 60 is controlled by incrementally unrolling the patch 61. The height of the fastener gun 72 from the patch 60 and hull 11 is controlled by a motorized lifting device 74 and swing arms 75. These lifting devices 74 are standard commercial products.

Once a section of patch 60 has entirely covered and been affixed over an opening 16, the applied patch 60 can be severed from the remaining rolled patch 61 by cutting the patch 60 along its entire width. The cutting instrument 78 operates using the same motor 77 and guideway rails 52 that are used to position the fastener gun 72. The height of the cutting instrument 78 from the patch 60 and hull 11 utilizes controlled motorized lifting device 74 and swing arms 75 similar to that used for the fastener gun 72. This enables the vehicle 50 to apply the remaining rolled patch 61 to additional openings 16, if necessary.

Other embodiments of the present invention can be realized other than those described. For example, the vehicle may not reside on board the vessel 1 prior to an accident, and so it must be transported to the accident site. In this embodiment, the vehicle control center 20 can be located virtually anywhere near the accident site, either on or off the vessel 1, and the vehicle storage center 30 is positioned on the deck 10 of the vessel 1 prior to deployment.

In another embodiment, the vehicle storage center 30 may consist of a generator, tether reel, communications, and other necessary equipment located on a buoy which is dropped along side the vehicle 50 from an aircraft or nearby marine vessel into the water 15 in the immediate vicinity of the damaged vessel 1. In this embodiment, the vehicle 50 swims to the hull 11 of the damaged vessel 1 and attaches itself 50 to the hull 11 while the vehicle storage center 30 floats nearby in water 15.

The aforementioned description of the invention has been presented for the purposes of description and illustration. This description is not intended to be all-inclusive or to limit the present invention to the precise form disclosed. As it will be appreciated by those skilled in the art, variations and modifications of the described embodiments are possible. These modifications and alterations are intended to fall with the scope of the claims.

What is claimed is:

1. Apparatus for sealing an opening in a hull of a vessel, comprising:

a vehicle for placement in water exterior to the hull of the vessel, the vehicle including means for traversing the vessel, a patch for sealing an opening in the hull, and means for securing the patch to the hull which comprises a plurality of fasteners inserted through the patch wherein an end of each fastener is inserted into the hull to create a lock between the fastener and the hull;

a vehicle control center having a display unit, data transmission link to the vehicle, operator controls and a computer control system for controlling vehicle control parameters; and an imaging system coupled to the vehicle control center for providing a view of the hull to the vehicle control center.

2. The apparatus of claim 1 further comprising a vehicle storage center located on or in the vessel for storing the vehicle.

3. The apparatus of claim 1 wherein the vehicle is attached to the hull.

4. The apparatus of claim 3 wherein the vehicle traverses the hull.

5. The apparatus of claim 1 wherein the imaging system comprises ultrasonic, sonar, and video imaging capabilities for providing visual images to the display unit.

6. The apparatus of claim 1 wherein the lock between the fastener and the hull is a friction lock and is enhanced by a chemical reaction initiated as the fastener contacts the hull.

7. The apparatus of claim 1 wherein the patch comprises one or more layers of material.

8. The apparatus of claim 1 further comprising a cutting mechanism located on the vehicle for severing an applied section of the patch from any remaining unused patch material.

9. A method for locating and assessing damage to and for sealing an opening in a hull of a vessel, comprising:

providing a vehicle external to the vessel;

moving the vehicle along the vessel;

controlling vehicle control parameters through a data transmission link to the vehicle from a control center;

viewing and assessing damage to the vessel through visual images of the hull transmitted by the vehicle to a display unit;

transporting a patch to a damaged area of the hull by use of the vehicle;

applying the patch to the hull using an application mechanism located on the vehicle such that the patch completely covers the damaged area;

attaching the patch to the hull using fastening means located on the vehicle; and severing the applied patch from any remaining unused patch material using a mechanism located on the vehicle.

10. Apparatus for sealing an opening in a hull of a vessel, comprising:

a vehicle for placement in water exterior to the hull of the vessel, the vehicle including means for traversing the vessel, a patch for sealing an opening in the hull, means for securing the patch to the hull, and a cutting mechanism for severing an applied section of the patch from any remaining unused patch material;

a vehicle control center having a display unit, data transmission link to the vehicle, operator controls and a computer control system for controlling vehicle control parameters; and an imaging system coupled to the vehicle control center for providing a view of the hull to the vehicle control center.

11. The apparatus of claim 10 further comprising a vehicle storage center located on or in the vessel for storing the vehicle.

12. The apparatus of claim 10 wherein the vehicle is attached to the hull.

13. The apparatus of claim 12 wherein the vehicle traverses the hull.

14. The apparatus of claim 10 wherein the imaging system comprises ultrasonic, sonar, and video imaging capabilities for providing visual images to the display unit.

15. The apparatus of claim 10 wherein the securing means comprises a plurality of fasteners inserted through the patch, an end of each fastener being inserted into the hull without penetrating completely through the entire thickness of the hull to create a lock between the hull and the fastener.

16. The apparatus of claim 15 wherein the lock between the fastener and the hull is a friction lock and is enhanced by a chemical reaction initiated as the fastener contacts the hull.

17. The apparatus of claim 10 wherein the patch comprises one or more layers of material.

18. The apparatus of claim 1 wherein the end of each fastener inserted into the hull to create the lock between the fastener and the hull is inserted without penetrating completely through the entire thickness of the hull.

* * * * *